United States Patent [19]

Wick

[11] Patent Number: 5,014,851

[45] Date of Patent: May 14, 1991

[54] PACKAGE ASSEMBLY FOR DISPENSING PHARMACEUTICAL MEDICATIONS AND METHOD OF MANUFACTURING THE SAME

[75] Inventor: John J. Wick, Swanton, Vt.

[73] Assignee: Multi-Comp, Inc., Lynchburg, Va.

[21] Appl. No.: 367,205

[22] Filed: Jun. 16, 1989

[51] Int. Cl.[5] ..... B65D 83/04

[52] U.S. Cl. ..... 206/539; 206/531; 206/534; 206/461; 206/813

[58] Field of Search ..... 206/461, 528, 531, 532, 206/534, 534.1, 813, 470, 363, 539, 538

[56] References Cited

U.S. PATENT DOCUMENTS

| | | | |
|---|---|---|---|
| 2,809,863 | 10/1957 | Curran | 206/263 |
| 3,173,540 | 3/1965 | Lapides | 206/463 |
| 3,397,671 | 8/1968 | Hartman, Jr. et al. . | |
| 3,494,322 | 2/1970 | Dubbels . | |
| 3,503,493 | 3/1970 | Nagy . | |
| 3,603,453 | 9/1971 | Serrell et al. . | |
| 3,630,346 | 12/1971 | Burnside | 206/534 |
| 3,738,480 | 12/1973 | Chesley | 206/534 |
| 3,780,856 | 12/1973 | Braverman . | |
| 3,856,144 | 12/1974 | Kelly . | |
| 4,106,621 | 8/1978 | Sorensen | 206/470 |
| 4,125,190 | 11/1978 | Davie, Jr. et al. . | |
| 4,211,326 | 7/1980 | Hein et al. . | |
| 4,254,871 | 3/1981 | Poore . | |
| 4,340,141 | 7/1982 | Fischer . | |
| 4,416,375 | 11/1983 | Braverman et al. . | |
| 4,429,792 | 2/1984 | Machbitz . | |
| 4,444,310 | 4/1984 | Odell . | |
| 4,469,258 | 9/1984 | Wright et al. | 206/631 |
| 4,496,052 | 1/1985 | Nertman | 206/470 |
| 4,503,123 | 3/1985 | Ou-Yang | 206/807 |
| 4,574,954 | 3/1986 | Reid | 206/532 |
| 4,664,262 | 5/1987 | White | 206/534 |
| 4,779,734 | 10/1988 | Kydonieus | 206/470 |
| 4,802,584 | 2/1989 | Harrison et al. | 206/447 |
| 4,844,246 | 7/1989 | Harrison et al. | 206/461 |

*Primary Examiner*—David T. Fidei

*Attorney, Agent, or Firm*—Bell, Seltzer, Park & Gibson

[57] ABSTRACT

The present invention includes a package assembly for dispensing pharmaceutical medications, and a method of manufacturing the same. The package assembly comprises a blister sheet having blister recesses and substantially planar shoulder portions located between the recesses and coated with a cohesive composition, and a lidding sheet having one surface entirely coated with a cohesive composition having affinity for the cohesive that is coated on the shoulder portions of the blister sheet, but having no affinity for pharmaceutical medications positioned in the blister recesses. A relatively stiff plastic frame having top and bottom panels is positioned on opposite sides of the blister sheet and lidding sheet in a sandwich relationship, thereby giving support to the entire package assembly. The present invention, therefore, allows for customized prescription packaging to be economically handled by a patient's pharmacist.

15 Claims, 2 Drawing Sheets

PACKAGE ASSEMBLY FOR DISPENSING PHARMACEUTICAL MEDICATIONS AND METHOD OF MANUFACTURING THE SAME

FIELD OF THE INVENTION

The pharmaceutical packaging industry is constantly changing and improving to try to meet the needs of patients requiring a wide range of medications. Patient non-compliance with medications prescribed by physicians, however, results in up to 15 percent of all hospital admissions. This problem of non-compliance increases as the number of prescriptions and doses for a patient increases. The present invention relates to a multiple dose compliance package and method for manufacturing the same. In addition to increasing patient compliance, the present invention provides for customized prescription packaging to be economically handled by a patient's pharmacist.

BACKGROUND OF THE INVENTION

The pharmaceutical packaging industry offers a wide array of dispensers and containers for all types of medications. These packages include conventional pill vials, as well as the now popular blister cards. The present prescription vial, however, offers no checks to either remind a patient of when to take the medicine, or whether the medication has in fact been taken. In those cases where a patient is on multiple medications, a number of different vials only serves to confuse a patient.

Recently, blister cards have overcome a number of the shortcomings of prescription vials and become increasingly popular. Exemplary patents discussing various advantages of blister packaging include the following: U.S. Pat. Nos. 4,429,792; 4,125,190; 3,856,144; and 3,780,856. Most of the blister packages of this type require specialized packaging machinery for assembly. Thus, such packages have the serious economic drawback that they are difficult and expensive to manufacture on a small or customized scale. The primary drawbacks with the prior art blister packages are the sealing material and the methods of sealing the plastic blister sheets to the lidding sheets. Typically, the blister sheets are sealed to the lidding sheets with the use of pressure-sensitive or heat-activated adhesives. The sticky nature of pressure-sensitive adhesives requires that the adhesive be carefully placed on a blister sheet and backing sheet in a specific pattern. The blister sheet and backing sheet are then carefully aligned and registered to seal in any medications. If the registration is not accurate, the adhesive may attach to the medications and possibly spoil the enclosed medications. Further, incomplete or inaccurate registration does not offer a sufficiently hermetic seal. Likewise, heat-activated adhesives require clumsy and inconvenient sealing devices. Further, the heat may have an adverse effect on medications being sealed in the package.

SUMMARY OF THE INVENTION

The present invention overcomes the drawbacks of these prior art packages and methods by the provision of a package assembly which comprises a blister sheet having a plurality of medication receiving blister recesses formed therein, with the sheet having substantially planar shoulder portions coated with a first cohesive composition, and a lidding sheet having one surface coated with a second cohesive composition having affinity for the first cohesive that is coated on the shoulders of the blister sheet but has no affinity for pharmaceutical medications. Therefore, the lidding sheet can be sealed to the shoulder portions of the blister sheet to encapsulate medications which are positioned within the blister recesses, without the demanding registration problems of prior art blister packages.

In a preferred embodiment, a backing sheet is adhered to the rear surface of the lidding sheet, and the backing sheet includes printed information arranged in registry with the blister recesses to identify the contents of each respective recess. Also, a supporting outer frame may be provided, with the outer frame having front and back panels positioned on opposite sides of the package, and with the front panel having apertures through which respective ones of the blister recesses protrude. The back panel preferably also includes apertures which are in registry with the blister recesses and the printed information, so as to permit the information to be visible.

Other features and advantages of the present invention will become apparent upon reading the following detailed description and appended claims, and upon reference to the accompanying drawings.

BRIEF DESCRIPTION OF THE DRAWINGS

For a more complete understanding of this invention, reference should now be had to the embodiment illustrated in greater detail in the accompanying drawings and described below by way of an example of the invention.

In the drawings.

DETAILED DESCRIPTION OF THE PREFERRED EMBODIMENT

Figure 1:
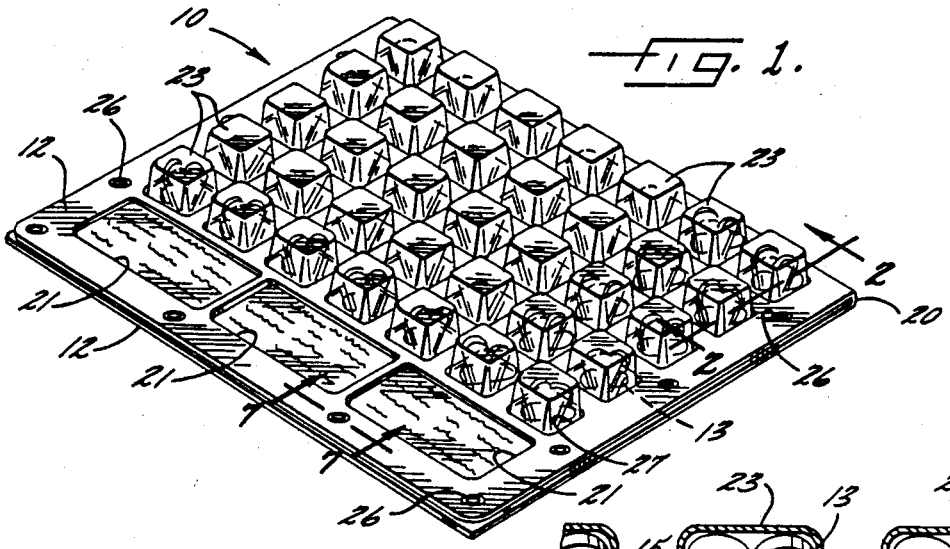
FIG. 1 is a perspective view of a blister package assembly embodying the present invention.

Turning first to FIG. 1, there is shown a preferred embodiment of a complete package assembly 10 which embodies the present invention. The package assembly is made up of a number of different components including a blister package 22 which comprises a blister sheet 11, an overlying lidding sheet 16, and a backing sheet 14 overlying the rear surface of the lidding sheet 16. The blister sheet 11 has a plurality of blister recesses 23 formed therein, and the assembly further includes an outer frame 12 having front and back panels positioned to overlie the opposite sides of the package 22.

Figure 8:
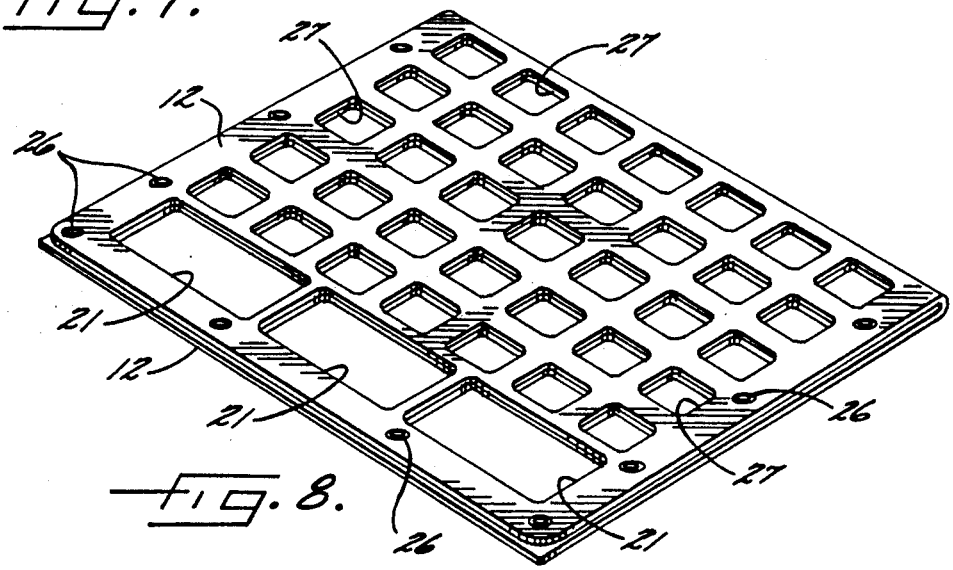
FIG. 8 is a perspective view of the outer frame of the assembly.

The blister recesses 23 of the blister sheet are arranged in a pattern, and the front panel of the frame 12 has apertures or openings 27 that correspond to and receive respective ones of the blister recesses, note FIG. 8. Each blister recess is fully supported by the stiff outer frame because the frame encases the package and is positioned on both sides of the package in a sandwich relationship. Preferably, the blister recesses are arranged in a matrix of rows and columns that correspond to a calendar or some other schedule convenient for a particular patient. The frame also has windows 21, see also FIG. 8, that allow portions of the backing sheet of the blister package to be visible. Writing appears on this visible portion of the backing sheet that preferably gives all of the information or labeling requirements of the pharmaceutical medications 13 that are sealed in each of the blisters of the package.

Figure 2:
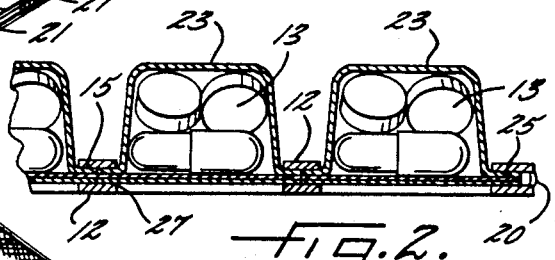
FIG. 2 is a fragmentary sectional side view of the blister package assembly taken along line 2—2 in FIG. 1.
Figure 7:
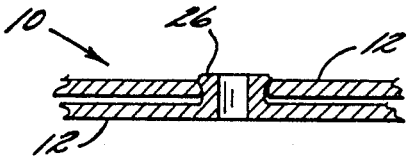
FIG. 7 is a fragmentary sectional view of the interengaging means of the outer frame and taken along the line 7—7 of FIG. 1.

Turning now to FIG. 2, there is shown the sandwich relationship of the frame 12 and the package 22. The stiff frame 12, which is preferably formed of a single molded plastic sheet, is shown positioned on either side of the blister package. The top and bottom panels of the frame 12 are hingedly connected to each other by a hinge 20 formed of a flexible integral piece of plastic along one side edge of the overlying panels. On the side edge of the panels opposite the edge hingedly interconnecting the panels and along both side edges, there are snaps 26 or other releasable interengaging means that hold the panels together and sandwiched around the package 22, note FIG. 7. Thus, the stiff frame 12 is positioned on opposite sides of the blister package and offers support to the entire package.

Referring again to FIG. 2, the frame 12 has apertures through which the blister recesses of the blister package 22 protrude Likewise, on the opposite panel or side of the frame, there are also apertures which make the back of the package 22 visible. Printed information relating to the specific medications in each blister, therefore, appears on the package in a general corresponding relationship to each blister.

Figure 3:
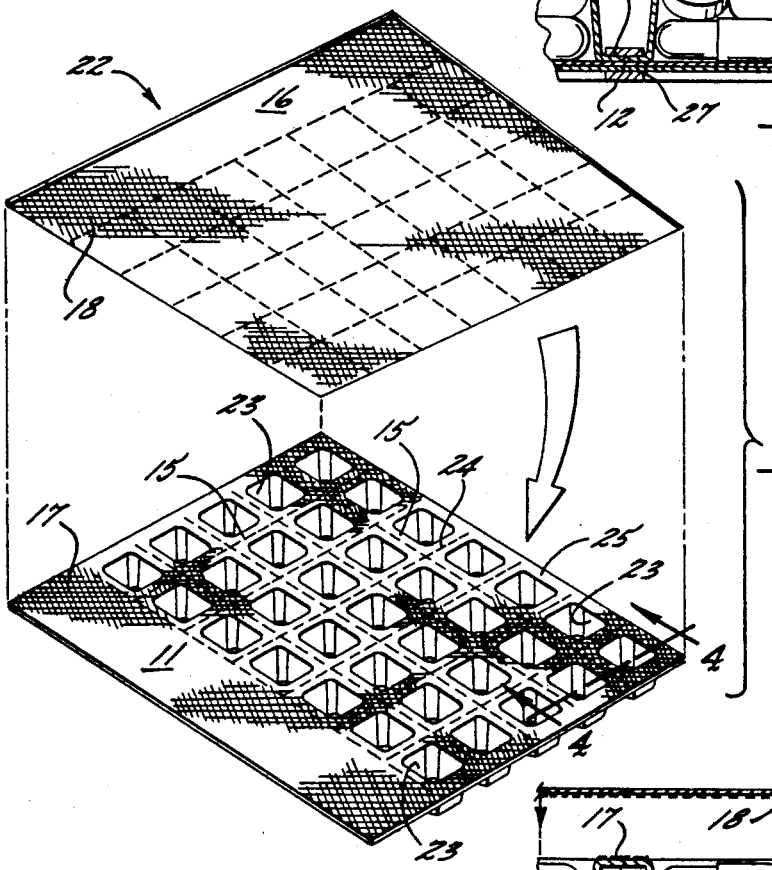
FIG. 3 is an exploded view of the blister sheet and lidding sheet embodying the present invention.

As best seen in FIG. 3, the blister package 22 includes the blister sheet 11 and the lidding sheet 16. The blister sheet 11 is formed from a flat, clear plastic sheet of a suitable transparent thermoplastic polymer such as polyvinyl chloride or polyethyleneterepthalate which has been thermoformed or die molded to form the pattern of blister recesses 23. The blister recesses are arranged in a plurality of columns and rows and are separated by substantially planar shoulder portions 15. The peripheral portions of the sheet 11 adjacent the edges of the sheet are also substantially flat and planar. As illustrated, score lines 24 are provided in the shoulder portions of the blister sheet 11 to form preweakened areas to facilitate separating the individual blisters from the package. This allows a patient's unused medications or blister recesses to be separated easily from the package and recycled or reused in other package assemblies.

The thermoplastic polymer that makes up the plastic sheet 11 must have sufficient barrier properties to prevent the diffusion of unwanted moisture and oxygen into the blister recesses of the package 22 that may spoil or deactivate the packaged medications. This barrier property may be formed by including a barrier layer in a plastic sheet before it is thermoformed or pressed into the blister sheet 11 form. The method of forming the sheet and the various compositions of the sheet are well known in the industry. The lidding sheet 16 is made of frangible material, typically relatively thin and flexible metal foil or plastic, that has barrier properties like those discussed above to insure the hermetic preservation of medications sealed in the package.

Figure 4:
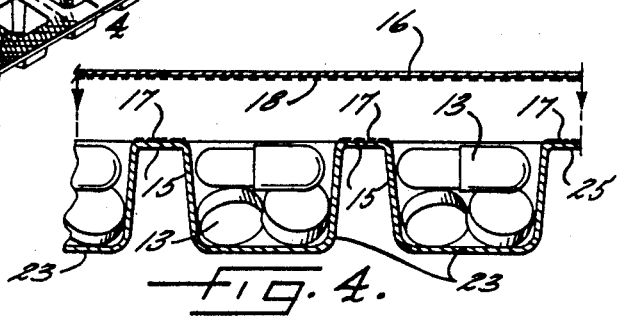
FIG. 4 is a fragmentary sectional side view taken along line 4—4 in FIG. 3.

As best seen in FIGS. 3 and 4, the upper surface of the shoulder portions 15, including the peripheral portions 25, of the plastic blister sheet 11 contain a coating 17 of a cohesive material. The coating can be applied by conventional methods and, alternatively, may be applied to the entire surface of the blister sheet. Also, the coating can be applied before or after a plastic sheet is formed or molded into the blister sheet 11. One entire surface of the lidding sheet 16 also bears a coating 18 of a cohesive material. The cohesive coating 18 on the lidding sheet and the cohesive coating 17 on the blister sheet can be of the same or of different compositions.

The cohesive coatings 17 and 18 serve to securely bond the blister sheet 11 to the lidding sheet 16 when the coated surfaces are positioned next to each other in the assembly of the package. Thus, the lidding sheet serves to close the blister recesses and encapsulate the medications therein. As used herein, the term "cohesive" refers to the ability of the coating to securely attach to and adhere to other surfaces coated with the same material or compatible cohesive material, yet have no bonding or adherent properties with other surfaces. Unlike conventional pressure sensitive adhesives, a cohesive is not inherently sticky or tacky and adherent to virtually any surface. The presence of cohesive on the entire surface of the lidding sheet does not affect the packaged medications or make them stick to the lidding sheet or blister sheet. Suitable cohesives include copolymers of vinyl acetate ethylene.

An advantage to using a cohesive is that the lidding sheets and blister sheets can be stored by stacking or rolling on each other as long as the cohesive-coated surface is not in contact with another cohesive-coated surface. This is particularly convenient for pharmacists storage and assembly of the packages. It alleviates the need for release sheets normally required with pressure sensitive adhesives. Further, a cohesive is advantageous over aqueous or solvent based adhesives that require drying delays in package assembly. A cohesive is also advantageous over thermally activated adhesives because specialized equipment is required to activate the adhesive and the heat that is applied may degrade or deactivate or otherwise adversely affect the packaged medications.

Figure 5:
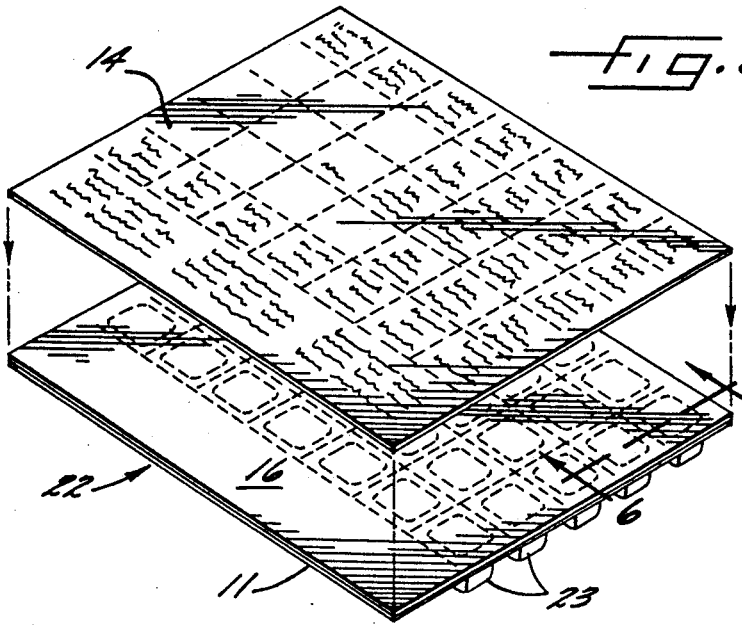
FIG. 5 is a perspective view of the blister sheet, lidding sheet and backing sheet embodying the present invention.
Figure 6:
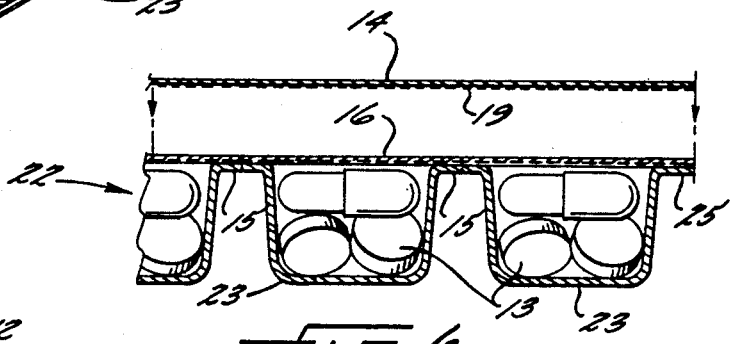
FIG. 6 is a fragmentary sectional view of the package and taken along line 6—6 of FIG. 5.

Referring now to FIGS. 5 and 6, a backing sheet 14 can be applied to the rear surface of the lidding sheet 16 of the blister package 22. The backing sheet 14 is preferably coated with an adhesive or glue material 19 for adhering the backing sheet to the lidding sheet 16. The backing sheet is preferably made of paper, because it is desirable to print information on the side of the backing sheet opposite the side having the adhesive and that relates to the packaged medications. The printed information, that can be written, typed or generated by a computer printer, sets forth required pharmaceutical labeling information, and the printed information is in registry with respective ones of the blister recesses Thus, the specific contents of each blister recess may be set forth in matrix form that corresponds to the blister recesses of the package when the backing sheet 14 is applied to the lidding sheet 16.

In practice, a pharmacist will be provided with a kit to prepare and assemble the package assembly on an individual basis pursuant to an individual's prescription. The kit includes plastic blister sheets having the previously-described coating of cohesive, and a supply of lidding sheets already coated with a cohesive material. The kit may also include a supply of backing sheets to be adhered to the back of the lidding sheet to identify the contents of the blisters. The kit may further include a supply of plastic frames to give the finished package assembly support and rigidity.

Contrary to earlier pharmaceutical packaging systems, the present invention allows the package to be assembled quickly and easily by a pharmacist. A pharmacist simply takes an empty blister sheet, positions it so that the blister recesses are oriented downwardly, and deposits pharmaceutical medications into the blister recesses. Once the medications are in the blisters, the lidding sheet is positioned over the blister sheet and the cohesive material on the lidding sheet is brought into contact with the cohesive material on the shoulders and periphery of the blister sheet. Enough pressure is applied to bring the entire surface of the shoulders and periphery into contact with the lidding sheet. A backing sheet may then be adhered to the lidding sheet. Alternatively, the backing sheet may be adhered to the lidding sheet before the lidding sheet is sealed to the blister sheet. The backing sheet may include printed information that corresponds to the medications in each blister that is in corresponding relationship to the printed information. The blister sheet, lidding sheet and backing sheet are then encased in a stiff outer frame having front and back panels or portions, one panel having apertures through which protrude the blisters and the other panel having apertures allowing the printed information corresponding to the medications in the blister to be visible. Also, the relatively thin and frangible nature of the lidding sheet and the overlying backing sheet permit the medications to be pushed therethrough and thus dispensed, by collapsing the associated blister recess.

From the foregoing, it can be seen that the package of the disclosed invention may be easily assembled without cumbersome apparatus otherwise necessary for pressure-sensitive or heat-activated sealing materials.

Once a patient receives a prescription in the package assembly, it is very easy and convenient to take the prescribed medications and keep track of medications already taken. The patient is able to look at the specific medications in the blister recesses to determine which blister contains the appropriate medications for a given time. Alternatively, or in addition to looking in the blister recesses, a patient can read the information printed on the backing sheet of the assembly that corresponds to the content of the specific blisters. Once the blister recess containing the appropriate medications is chosen, the patient merely presses against the blister recess, thus forcing the medications to puncture and dispense through the lidding sheet and backing sheet.

While a particular embodiment of the invention has been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and the scope of the invention.

That which is claimed is:

1. A package assembly for dispensing pharmaceutical medications comprising a blister sheet having a plurality of medication receiving blister recesses formed therein, with said sheet including substantially planar shoulder portions disposed between the blister recesses and along the peripheral portions of the sheet, a surface coating of a first cohesive composition provided on said shoulder portions of the sheet;

pharmaceutical medications positioned in at least some of said blister recesses of said blister sheet; and a lidding sheet having one surface thereof coated with a second cohesive composition having a cohesive affinity for said first cohesive composition but having no affinity for said pharmaceutical medications, said lidding sheet being positioned in overlying relationship to said shoulder portions of said blister sheet with said second cohesive composition cohesively sealing the lidding sheet to said blister sheet along said shoulder portions to thereby close said blister recesses and encapsulate the medications therein.

2. A package assembly according to claim 1 wherein said blister recesses are arranged in a plurality of columns and rows on said blister sheet, and said package assembly further includes a backing sheet having printed information thereon pertaining to the medication in each of said blister recesses on the blister sheet, the printed information being arranged in columns and rows corresponding to the locations of the medications in the blister recesses, and means adhering the backing sheet to the lidding sheet with the printed information located in registration with the medications in the blister sheet.

3. A package assembly according to claim 1 wherein said blister sheet further includes a matrix of preweakened lines in the shoulder portions and around each blister recess.

4. A package assembly for dispensing pharmaceutical medications comprising a blister sheet having a plurality of medication receiving blister recesses formed therein, with said blister recesses being arranged in a plurality of columns and rows, and with the sheet including substantially planar shoulder portions disposed between the columns and rows of blister recesses and along the peripheral portions of the sheet, a surface coating of a first cohesive composition provided on substantially all of said shoulder portions of the sheet;

pharmaceutical medications positioned in said blister recesses of said blister sheet;

a lidding sheet having one surface thereof substantially entirely coated with a second cohesive composition having a cohesive affinity for said first cohesive composition but having no affinity for said pharmaceutical medications, said lidding sheet being positioned in overlying relationship to said blister sheet with said second cohesive composition cohesively sealing the lidding sheet to said blister sheet along said shoulder portions and peripheral portions and to thereby close said blister recesses and encapsulate the medications therein, and a relatively stiff, outer frame having front and back panels positioned on opposite sides of the package, said front panel having apertures through which respective ones of said blister recesses protrude.

5. A package assembly as defined in claim 4 further comprising a backing sheet adhered to the side of said lidding sheet opposite said blister recesses, said backing sheet having printed information thereon pertaining to the medication in each of said blister recesses, and wherein said back panel includes a plurality of apertures which are aligned opposite respective ones of said blister recesses and through which said printed information is visible.

6. A package as defined in claim 4 wherein said front and back panels of said outer frame are physically interconnected along a fold line extending along one side edge thereof.

7. A package as defined in claim 6 wherein said front and back panels of said outer frame include releasable interengaging means on the side edge thereof opposite said fold line for releasably securing said panels together.

8. A kit for manufacturing a package assembly for dispensing pharmaceutical medications comprising a blister sheet having a plurality of medication receiving blister recesses formed therein, with said sheet including substantially planar shoulder portions disposed between the blister recesses and along the peripheral portions of the sheet, a surface coating of a first cohesive composition provided on said substantially planar shoulder portions of the sheet; and a lidding sheet having one surface thereof coated with a second cohesive composition having a cohesive affinity for said first cohesive composition, but having no affinity for pharmaceutical medications, said lidding sheet being positionable in overlying relationship to the blister sheet to allow subsequent cohesive sealing of the lidding sheet to said blister sheet along said shoulder portions and to thereby encapsulate medications in the respective blister recesses.

9. A kit according to claim 8 further comprising a stiff, outer frame having front and back panels positionable on opposite sides of the package, the front panel having apertures through which said blister recesses protrude and the back panel having apertures through which the medications may be dispensed.

10. A method of producing a package assembly for dispensing pharmaceutical medications comprising providing a blister sheet having a plurality of medication receiving blister recesses formed therein, with said sheet including substantially planar shoulder portions disposed between the blister recesses and along the peripheral portions of the sheet, and with said shoulder portions having a surface coating of a first cohesive composition thereon;

positioning the blister sheet with the blister recesses thereof oriented downwardly and depositing pharmaceutical medications into the respective blister recesses;

providing a lidding sheet having one surface thereof coated with a second cohesive composition having a cohesive affinity for said first cohesive composition but having no affinity for pharmaceutical medications; and positioning the cohesive coated surface of said lidding sheet in overlying relationship to the pharmaceutical medication containing blister sheet and applying pressure to cohesively seal the lidding sheet to said blister sheet along said shoulder portions and to thereby encapsulate the medications in the respective blister recesses.

11. A method according to claim 10 wherein said blister recesses are arranged in a plurality of columns and rows on said blister sheet, and wherein the method includes the additional steps of printing information pertaining to the medication in each blister recess on a backing sheet with the printed information arranged in columns and rows corresponding to the locations of the medications in the blister recesses, and adhering the backing sheet to the lidding sheet with the printed information located in registration with the medications in the blister sheet.

12. A method according to claim 10 wherein said first and second cohesive compositions are composed of the same material.

13. A method according to claim 10 wherein said blister sheet further includes a matrix of preweakened lines in the shoulder portions around each blister recess.

14. A method according to claim 10 including the additional step of encasing said package assembly in a stiff, outer frame having front and back panels, the front panel having apertures through which protrude the blister recesses and the back panel having apertures corresponding to the blister recesses.

15. A method of producing a package assembly for dispensing pharmaceutical medications comprising providing a blister sheet having a plurality of medication receiving blister recesses formed therein, with the blister recesses being arranged in a plurality of columns and rows, and with substantially planar shoulder portions being disposed between the columns and rows of said blister recesses and along the peripheral portions of the sheet, and with said shoulder portions having a surface coating of a first cohesive composition thereon;

positioning the blister sheet with the blister recesses thereof oriented downwardly and depositing pharmaceutical medications into the respective blister recesses;

providing a lidding sheet having one surface thereof coated with a second cohesive composition having a cohesive affinity for said first cohesive composition but having no affinity for pharmaceutical medications;

positioning the cohesive coated surface of said lidding sheet in overlying relationship to the pharmaceutical medication containing blister sheet and applying pressure to cohesively seal the lidding sheet to said blister sheet along said shoulder portions and peripheral portions and to thereby encapsulate the medications in the respective blister recesses;

printing information pertaining to the medication in each blister recess on a backing sheet while arranging the printed information in columns and rows corresponding to the locations of the medications in the blister recesses;

adhering the backing sheet to the lidding sheet with the printed information located in registration with the medications in the blister sheet so as to identify the medication contained in the respective blister recesses; and encasing the package in a stiff, outer frame having front and back panels, the front panel having apertures through which protrude the blister recesses and the back panel having apertures through which the printed information on said backing sheet is visible.

* * * * *